428-570 SR
1/1/80 XR 4,181,525

United States Patent [19]
Novinski

[11] 4,181,525
[45] Jan. 1, 1980

[54] SELF-BONDING FLAME SPRAY POWDERS FOR PRODUCING READILY MACHINABLE COATINGS

[75] Inventor: Edward R. Novinski, Mineola, N.Y.

[73] Assignee: Metco, Inc., Westbury, N.Y.

[21] Appl. No.: 926,070

[22] Filed: Jul. 19, 1978

[51] Int. Cl.[2] ..... B22F 7/00
[52] U.S. Cl. ..... 75/255; 428/570
[58] Field of Search ..... 75/255; 428/570

[56] References Cited

U.S. PATENT DOCUMENTS

| | | | |
|---|---|---|---|
| 3,305,326 | 2/1967 | Longo | 428/570 |
| 3,925,059 | 12/1975 | Fontaine et al. | 428/570 |
| 3,936,295 | 2/1976 | Cromwell et al. | 428/570 |

*Primary Examiner*—W. Stallard
*Attorney, Agent, or Firm*—S. A. Giarratana; F. L. Masselle; E. T. Grimes

[57] ABSTRACT

A flame spray powder comprising particles having a core of nickel, iron, copper, cobalt or alloys thereof coated with a binder containing discrete particles of aluminum and substantially pure nickel. The core material should be present in amounts of 70–98, and preferably 80–94, weight percent of the total metal content of the powder. The core particles should range in size between −60 mesh and +3 microns, and preferably −100 mesh and +400 mesh. The core material is most preferably nickel, and the coating may, in addition to the aluminum and nickel, contain molybdenum.

13 Claims, No Drawings

SELF-BONDING FLAME SPRAY POWDERS FOR PRODUCING READILY MACHINABLE COATINGS

This invention relates to a self-bonding flame spray powder for producing readily machinable coatings. The invention more particularly relates to a self-bonding composite flame spray powder of the type disclosed in U.S. Pat. No. 3,322,515, and which is capable, upon spraying, of producing a readily machinable, high-grade coating.

Flame spray materials which are capable of bonding to a clean surface without special surface preparations are referred to in the art as self-bonding flame spray materials. One class of such self-bonding flame spray materials are described in U.S. Pat. No. 3,322,515. This patent, for example, describes composite flame spray powders in the form of individual core particles coated with a binder containing discrete particles of a different metal, as for example, a powder formed of a nickel core coated with a binder containing finely divided, discrete particles of aluminum. This powder has found wide commercial use and acceptance in the flame spray field. The coatings formed with this type of flame spray powder are generally not, however, readily machinable, and if ultimate machining is required, it is generally preferable to overspray the material with readily machinable metal.

U.S. Pat. No. 3,338,688 teaches that the tendency of the nickel-aluminum composite powders of U.S. Pat. No. 3,322,515 to smoke may be reduced by adding up to about 2 percent of nickel-boron to the coating layer of the particles. While the addition of the nickel-boron substantially reduces the smoking tendency of the powder during spraying, it does little or nothing to improve the machinability of the coating formed.

One object of this invention is an improved self-bonding flame spray powder capable of forming a high-grade coating of improved machinability characteristics.

This and further objects will become apparent from the following description.

In accordance with the invention, the addition of a minor amount of pure nickel particles to the coating layer of certain types of self-bonding composite flame spray powders will alter the characteristics of these powders so that, upon flame spraying, high-grade, readily machinable coatings will be produced without any sacrifice of the other characteristics normally obtained upon spraying these composites.

The core of the flame spray powders in accordance with the invention is either nickel, iron, copper, cobalt or alloys thereof, and is most preferably nickel. The core particles should have a size between −60 mesh, U.S. Standard Screen Size, and +3 microns, and preferably between −100 mesh, U.S. Standard Size, and +400 mesh (37 microns). The core is coated with discrete particles of aluminum and substantially pure nickel. The aluminum should be in the form of a fine particle having a particle size between about 1 and 37 microns, and the pure nickel may also be in this form and of this size, but is preferably in the form of flakes having a length between about 140 and 5μ and a thickness between 0.5 and 10μ, and preferably a length between about 80 and 5μ and a thickness between about 0.5 and 2μ. The aluminum, if desired, may also be in this flake form. The term "substantially pure nickel" as used herein and in the claims is intended to designate metallic nickel which does not contain more than 5 atomic percent of impurities. Nickel may be obtained from any known source, provided it has this purity. For example, pure nickel, commercially known as "carbonyl nickel" from the reduction process used in its production, may be used.

The other components of the powder, such as the aluminum coating material and the core material, may be of a form as known in the art, as described, for example, in U.S. Pat. Nos. 3,322,515 and 3,338,688.

The composite powder in accordance with the invention, except for the addition of the pure nickel particles to the coating layer, may be manufactured and used in the known conventional manner, as described in U.S. Pat Nos. 3,322,515 and 3,338,688. Thus, for example, the aluminum and substantially pure nickel coating particles may be mixed with a binder, so as, in effect, to form a paint in which the aluminum and substantially pure nickel particles correspond to the pigment, and this paint is then used to coat the core particles and allowed to set or dry.

The binder material may be any known or conventional binding material which may be used for forming a coating or binding particles together or to a surface. The binder is preferably a varnish containing a resin as the varnish solids and may contain a resin which does not depend on solvent evaporation in order to form a dried or set film. The varnish may, thus, contain a catalyzed resin as the varnish solids. Examples of binders which may be used include the conventional phenolic, epoxy or alkyd varnishes, varnishes containing drying oils, such as tung oil and linseed oil, rubber and latex binders, and the like. The binder may additionally be of the water-soluble type, as for example, of the polyvinylpyrrolidone or polyvinylalcohol type.

The coating of the core material with the "paint" containing the aluminum and substantially pure nickel may be effected in any known or desired manner, and it is simply necessary to mix the two materials together and allow the binder to set and dry, which will result in a fairly free-flowing powder consisting of the core coated with the cladding of the aluminum and substantially pure nickel.

The final size of the flame spray particles may be in the range between approximately −60 mesh, U.S. Standard Screen Size, and +5 microns, and preferably between about −80 mesh, U.S. Standard Screen Size, and +10 microns.

The aluminum and substantially pure nickel may each be present in an amount ranging from about 1 to 15, and preferably 3 to 10, weight percent based on the total metal content of the particles. In addition to the aluminum and the substantially pure nickel, the coating layer may additionally contain other materials, such as fine molybdenum powder in amount of about 1 to 10, and preferably 2 to 7, weight percent based on the total metal content. The fine molybdenum powder may correspond in size and form to the aluminum powder utilized in the coating layer of the core. Thus, the powder may be similar to the powder described in U.S. Pat. No. 3,841,901, with the addition of the pure nickel particles in the coating layer according to this invention.

The powders are sprayed in the conventional manner, using a powder-type flame spray gun, though it is also possible to combine the same into the form of a wire or rod, using plastic or a similar binding, as for example, polyethylene or polyurethane, which decomposes in the heating zone of the gun. When formed as wires, the same may have conventional sizes and accuracy tolerances for flame spray wires and, thus, for example, may vary between about ¼ inch and 20 gauge.

The spraying is in all respects effected in the conventional manner previously utilized for self-bonding flame spray material, and in particular nickel-aluminum composites. Due to the self-bonding characteristics, special surface preparation other than good cleaning is not required, though, of course, conventional surface preparation may be utilized, if desired.

The powder in accordance with the invention, as contrasted to the prior-known nickel-aluminum self-bonding powders, forms a coating of excellent machinability. When the coating is, for example, turned on a lathe, bright, uniform, sharp machine grooves are formed, with long machining chips being removed. Cutting tool wear is generally low. As contrasted to this, the coatings formed from the prior-known nickel-aluminum self-bonding powders are only poorly machinable, showing dull, uneven cutting grooves, with powder material removal and high cutting tool wear. The coatings formed in accordance with the invention may be machined at a much higher speed than the prior known coatings, and the powders, during spraying, show low smoking characteristics.

The powders in accordance with the invention may be used wherever it is desirable to produce a hard, wear-resistant coating that may be readily machined. Due to this characteristic, the powders are generally sprayed as a final coating, though, if desired, the powders may be sprayed in conjunction with, or addition to, other flame spray materials conventionally used in the art and may even, if desired, be utilized as a bonding coat for further spray material.

The following examples are given by way of illustration and not limitation.

EXAMPLE 1

Finely-divided aluminum powder having a particle size ranging between about 1 and 37 microns was blended with an equal amount by weight of pure nickel flakes having a length between 5 and 80μ and a thickness between about 0.5 and 2μ in a conventional phenolic varnish having approximately 10 percent solid contents, to form a mixture having the consistency of heavy syrup and containing about 60 percent by weight of the metal particles. The blend of the varnish with the aluminum particles and nickel flake was then added to nickel core particles having a size ranging between −100 mesh and +400 mesh, U.S. Standard Screen Size, in amount so that the final mixture contained 92 percent by weight of the nickel core particles, 4 percent by weight of the aluminum particles and 4 percent by weight of the nickel flake. After all the ingredients were thoroughly blended together, the mixing was continued until the varnish dried, leaving a fairly free-flowing powder in which all of the nickel core particles were clad with a dry film which contained the aluminum particles and the substantially pure nickel flake. The particles were then warmed to about 250° F. to insure complete drying, and the dry powder was screened to a screen size between −140 and +325 mesh, U.S. Standard Screen Size.

The powder is flame sprayed on a steel shaft of 1 inch diameter which has been surface-cleaned by smooth grinding. Spraying is effected at a distance between about 5 and 6 inches from the shaft, with the shaft being turned in a lathe, using a powder-type flame spray gun as described in U.S. Pat. No. 2,961,335 of Nov. 22, 1960, and sold by Metco, Inc., of Westbury, New York, as a Metco-type 5P Thermospray gun. Spraying is effected at a spray rate of 5.6 pounds per hour, using acetylene as the fuel at a pressure of 13 pounds per square inch and a flow rate of 33 cubic feet per hour and oxygen as the oxidizing gas at a pressure of 15 pounds per square inch and a flow rate of 47 cubic feet per hour. The coating was built up to a thickness of 15–20 thousandths of an inch and showed a bond strength between about 4,000 and 5,000 psi. During the spraying, very little smoke was generated.

The as-sprayed coating showed a Rockwell hardness of RB 68 and was turned in a lathe to produce screw threads. The threads produced were bright and uniform with sharply machined grooves and produced during the turning 5-inch long machining chips. A carbide-type cutting tool was used which showed only low wear, and the coating allowed a turning speed of 225 surface feet per minute. As contrasted to this, a self-bonding powder produced in the identical manner (without, however, the nickel flake) and sprayed in the identical manner produced a coating which showed a dull, uneven cutting with a non-uniform machine groove upon turning and with powdery material removal, showing a high cutting tool wear even at a turning speed of only 10 surface feet per minute. In the same manner, if the substantially pure nickel flake is substituted with nickel-boron containing, for example, 18 percent by weight of boron, the coating produced is only poorly machinable.

EXAMPLE 2

Example 2 was repeated, except that molybdenum powder corresponding in size to the aluminum powder was initially blended with the aluminum powder and nickel flake, using equal weight proportions of these three components. The final composite powder contained 4 percent by weight of the aluminum, 4 percent by weight of the nickel flake, and 4 percent by weight of the molybdenum, based on the total metal content of the powder. The coating produced had a Rockwell hardness of Rb 70, had a bond strength of about 7,800 psi, and excellent machinability.

EXAMPLE 3

Example 1 was repeated, using in place of the nickel flake, pure metallic nickel powder, commercially designated "carbonyl nickel," having a particle size corresponding to that of the aluminum powder. Comparable results were obtained.

EXAMPLE 4

Example 1 was repeated, using in place of the nickel powder core material, a low carbon iron powder corresponding in particle size to the nickel core powder. Spray coatings of the resultant material exhibited excellent machined surfaces at higher turning speeds than a material prepared containing no fine nickel powder. Additionally, this new material demonstrated strong self-bonding adherence to mild steel surfaces.

EXAMPLE 5

Example 1 was repeated, using in place of the nickel core material, commercially pure copper powder corresponding in particle size to the nickel core powder. Sprayed coatings of the resultant material produced fine machined finishes, self-bonding to smooth mild steel surfaces, and low smoke and fume generation during spraying.

While the invention has been described in detail with reference to certain specific embodiments, various changes and modifications which fall within the spirit of the invention and scope of the appended claims will become apparent to the skilled artisan. The invention is, therefore, only intended to be limited by the appended claims or their equivalents, wherein I have endeavored to claim all inherent novelty.

What is claimed is:

1. A flame spray powder comprising particles having a core comprising a member selected from the group consisting of nickel, iron, copper, cobalt and alloys thereof, coated with a binder containing discrete particles of aluminum and substantially pure nickel.

2. Flame spray powder according to claim 1, in which said discrete particles of aluminum and substantially pure nickel are in the form of at least one of a powder having a size between about 1 and 37 microns and flakes of a size between about 5 and 140$\mu$ length and 0.5 and 10$\mu$ thickness.

3. Flame spray powder according to claim 1 or 2, in which said discrete particles are present in amount of about 2 to 30 weight percent based on the total metal in the powder, with at least 1 weight percent of each of said aluminum and substantially pure nickel, said core having a size between about −60 mesh, U.S. Standard Screen Size, and +3 microns.

4. Flame spray powder according to claim 1, in which said discrete particles are present in amount between about 6 and 20 weight percent based on the total metal in the powder, with at least 2 weight percent of each of said aluminum and substantially pure nickel, said discrete particles being in the form of at least one of a powder having a size between about 1 and 37 microns and flakes having a length between about 5 and 80$\mu$ and a thickness between about 0.5 and 2$\mu$, the flame spray powder particles having a size between about −60 mesh, U.S. Standard Screen size, and +5 microns.

5. Flame spray powder according to claim 4, having a size between about −80 mesh, U.S. Standard Screen Size, and +10 microns.

6. Flame spray powder according to claim 1, in which said binder additionally contains discrete particles of molybdenum in amount up to 10 percent by weight based on the total metal present in the powder.

7. Flame spray powder according to claim 6, in which said molybdenum is present in amount of about 2 to 7 weight percent based on the total metal in the powder, and has a particle size between about 1 and 37 microns.

8. A flame spray powder comprising particles having a nickel core coated with a binder containing discrete particles of aluminum and substantially pure nickel, said aluminum and substantially pure nickel each being present in amount of about 4 percent by weight based on the total metal in the powder.

9. Flame spray powder according to claim 8, in which said substantially pure nickel is in the form of nickel flake.

10. Flame spray powder according to claim 8, additionally containing discrete particles of molybdenum in the binder in amount up to about 4 percent by weight based on the total metal in the powder.

11. In the flame spray process in which a flame spray powder is at least heat-softened in a heating zone and propelled onto a surface to be coated, the improvement which comprises flame spraying a flame spray powder comprising particles having a core comprising a member selected from the group consisting of nickel, iron, copper, cobalt and alloys thereof, coated with a binder containing discrete particles of aluminum and substantially pure nickel.

12. Improvement according to claim 11, in which said aluminum and substantially pure nickel are each present in amount between about 3 and 10 percent by weight based on the total metal in the powder.

13. Improvement according to claim 12, in which said substantially pure nickel is in the form of nickel flake.

* * * * *